US009970650B1

(12) United States Patent
Afzali et al.

(10) Patent No.: US 9,970,650 B1
(45) Date of Patent: May 15, 2018

(54) I-SEE SYSTEM AND METHOD

(71) Applicants: Waheed Afzali, Sacramento, CA (US); Farashta Afzali, Sacramento, CA (US)

(72) Inventors: Waheed Afzali, Sacramento, CA (US); Farashta Afzali, Sacramento, CA (US)

( * ) Notice: Subject to any disclaimer, the term of this patent is extended or adjusted under 35 U.S.C. 154(b) by 103 days.

(21) Appl. No.: 14/873,196

(22) Filed: Oct. 2, 2015

Related U.S. Application Data

(60) Provisional application No. 62/059,098, filed on Oct. 2, 2014.

(51) Int. Cl.

| | |
|---|---|
| ***F21V 33/00*** | (2006.01) |
| ***F21L 4/02*** | (2006.01) |
| ***F21L 4/08*** | (2006.01) |
| ***F21V 21/14*** | (2006.01) |
| ***F21V 23/04*** | (2006.01) |
| *F21W 111/10* | (2006.01) |

(52) U.S. Cl.
CPC ..... *F21V 33/0008* (2013.01); *F21L 4/02* (2013.01); *F21L 4/08* (2013.01); *F21V 21/145* (2013.01); *F21V 23/0414* (2013.01); *F21W 2111/10* (2013.01)

(58) Field of Classification Search
CPC ..... F21V 33/0008; F21V 21/145; F21V 23/0414; F21L 4/02; F21L 4/08; F21W 2111/10
See application file for complete search history.

(56) References Cited

U.S. PATENT DOCUMENTS

| | | | | |
|---|---|---|---|---|
| 3,641,333 | A * | 2/1972 | Gendron | A41D 13/01 340/321 |
| 3,840,853 | A | 10/1974 | Cukale | |
| 3,944,803 | A * | 3/1976 | Chao | A01K 27/006 119/859 |
| 5,535,106 | A * | 7/1996 | Tangen | A01K 27/006 119/859 |
| 2012/0253485 | A1 | 10/2012 | Weast et al. | |
| 2013/0188335 | A1 | 7/2013 | Marche et al. | |

* cited by examiner

*Primary Examiner* — David V Bruce
(74) *Attorney, Agent, or Firm* — RG Patent Consulting, LLC; Rachel Gilboy

(57) ABSTRACT

An apparatus for a user portable lighting system. In the system, multiple spaced apart lighting features arranged about a circumferential surface about the user in a substantially 360 degree field of user view to provide a hands-free lighting system.

19 Claims, 4 Drawing Sheets

I-SEE SYSTEM AND METHOD

CROSS-REFERENCE TO RELATED APPLICATION

The present application is related to and claims priority from prior provisional application Ser. No. 62/059,098, filed Oct. 2, 2014, which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of waist bands and belts housing light emitting diodes and more specifically relates to a portable, hands-free lighting system comprised of a wearable belt, the surface of which is covered in a series of shatterproof lights to provide consumers a readily available light source that can be utilized to illuminate one's path when in darkened environments, such as when jogging or walking at night, while also alerting others to one's presence on the road.

2. Description of the Related Art

Raising the bar on pedestrian safety in intersection crosswalks and sharpening driver awareness of pedestrians in street crossings are important nationwide objectives. To illustrate the seriousness of this problem, it is worth noting that in one city alone, Washington, D.C., at least nine pedestrians were killed in pedestrian—vehicle accidents during a recent month. A recent article in the local paper reported on seven pedestrians who had been killed or injured during rush hour on a single day. It is important to remember that pedestrians are frequently not at fault when struck by automobiles.

Data also shows that almost half of all pedestrian injuries occur while the pedestrian is crossing at the intersection in the crosswalk. This is especially common during the evening hours, when poorly lit roads can result in a pedestrian being virtually invisible to a passing motorist. Not limited to pedestrians, the risk of being struck by a vehicle during the evening hours is also common to those who enjoy jogging or walk their pets during the evening hours. Should one live in a suburban or rural area where street lighting is minimal, the risk of being unseen by a passing motorist is heightened. As such, many consumers carry a flashlight with them when spending time outdoors after dark, not only to provide a recognizable beacon that can be seen by motorists, but also in order to illuminate a darkened path. Flashlights are also employed by campers, hikers and other outdoor enthusiasts as a means of easily viewing one's surroundings after the sun has set for the evening.

Unfortunately, carrying a flashlight can be a bit of a challenge, especially if one is simultaneously attempting to control a leashed dog, or carry a heavy pack loaded with supplies. Further, flashlights only illuminate the path directly in front of the user and thus a motorist approaching from the side or behind a walker may not notice their presence on the road until it is too late to make a safe spot.

Various attempts have been made to solve problems found in waist bands and belts housing light emitting diodes art. Among these are found in: U.S. Publication No. 2013/0188335 to Marche et al; U.S. Publication No. 2012/0253485 to Aaron B. Weast; and U.S. Pat. No. 3,840,853 to Edward M. Cukale. This prior art is representative of waist bands and belts housing light emitting diodes.

None of the above inventions and patents, taken either singly or in combination, is seen to describe the invention as claimed. Thus, a need exists for a reliable I-See a portable, hands-free lighting system comprised of a wearable belt, the surface of which is covered in a series of shatterproof lights to provide consumers a readily available light source that can be utilized to illuminate one's path when in darkened environments, such as when jogging or walking at night, while also alerting others to one's presence on the road. I-See would also be employed to provide a portable light source for use when camping, hiking or engaged in other activities after dark, as well as for use during emergency situations and to avoid the above-mentioned problems.

BRIEF SUMMARY OF THE INVENTION

In view of the foregoing disadvantages inherent in the known waist bands and belts housing light emitting diodes art, the present invention provides a novel I-See. The general purpose of the present invention, which will be described subsequently in greater detail, is to provide a portable, hands-free lighting system comprised of a wearable belt, the surface of which is covered in a series of shatterproof lights to provide consumers a readily available light source that can be utilized to illuminate one's path when in darkened environments, such as when jogging or walking at night, while also alerting others to one's presence on the road.

I-See would also be employed to provide a portable light source for use when camping, hiking or engaged in other activities after dark, as well as for use during emergency situations.

A portable lighting system is disclosed for a user. The system includes multiple spaced apart lighting features arranged about a circumferential surface about the user in a substantially 360 degree field of user view to provide a hands-free lighting system.

A method is disclosed for creating a portable lighting system for a user. The method includes steps of: detachably attaching multiple spaced apart lighting features; arranging the multiple spaced apart lighting features about a circumferential surface about the user; and providing a substantially 360 degree field of user view to provide a hands-free lighting system.

The present invention holds significant improvements and serves as a portable, hands-free lighting system and method. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, portable, hands-free lighting system, i.e., I-See, constructed and operative according to the teachings of the present invention.

The various embodiments of the present invention will hereinafter be described in conjunction with the appended drawings, wherein like designations denote like elements.

DETAILED DESCRIPTION

Figure 1:
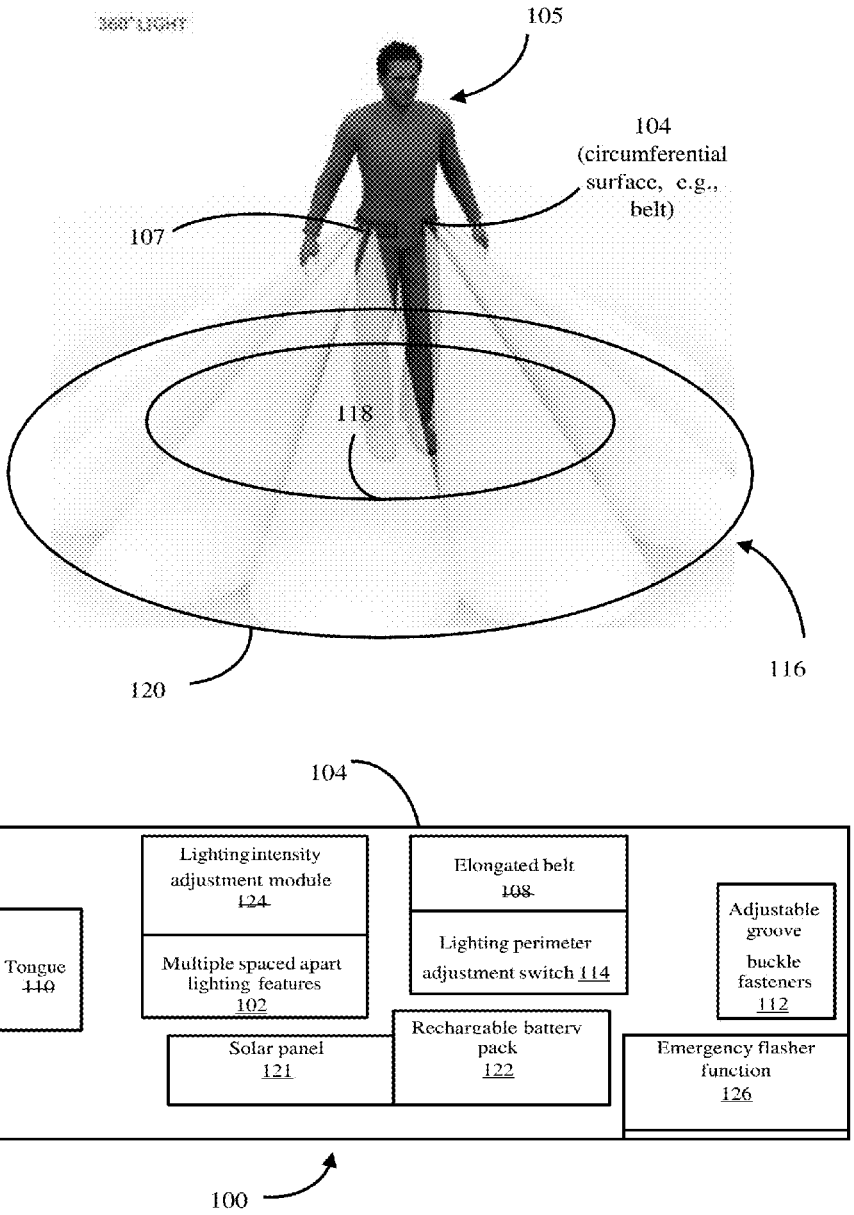
FIG. 1 displays a perspective view illustrating a portable, hands-free lighting system, i.e., I-See, to an embodiment of the present invention.

As discussed above, embodiments of the present invention relate to a waist bands and belts housing light emitting diodes. More particularly to I-See, a portable, hands-free lighting system comprised of a wearable belt, the surface of which is covered in a series of shatterproof lights to provide consumers a readily available light source that can be utilized to illuminate one's path when in darkened environments, such as when jogging or walking at night, while also alerting others to one's presence on the road. I-See would also be employed to provide a portable light source for use when camping, hiking or engaged in other activities after dark, as well as for use during emergency situations.

Referring now to the drawings FIGS. 1-5, I-See includes a novel product offering consumers a practical solution to the aforementioned challenges. As the name implies, I-See includes a specially designed wearable belt, the surface of which is covered in a series of shatterproof lights that illuminates a perimeter of 10 feet around the wearer.

Most generally, affording 360 degrees of lighting around one's body, I-See was developed for anyone who engages in outdoor activities at night, such as joggers, walkers, pet owners, campers and the like. This light source would also be employed for practical uses inside and outside the home, particularly during emergency situations and power outages. I-See would be manufactured from a variety of materials with high end versions manufactured of leather and additional options including canvas, nylon or comparable durable and stretchy material.

As with traditional belts, I-See would be comprised of an elongated length of belting, held comfortably in place over the natural waist by way of an adjustable tongue and groove buckle fastener. This product would be offered in men's and women's sizes small, medium, large, extra large and double extra large, with versions offered for wear by children and teens made available in sizes small, medium, large and extra large. This unique belt would also be offered in a variety of colors to appeal to males and females including black, pink, white, red, silver and yellow, to name a few considerations.

Prior to wear, the user would charge I-See's internal battery by placing the unit in a direct source of natural light. I-See belt would then be easily donned by simply wrapping the unit about the natural waist and securing the belt via the integrated tongue and groove buckle fastener. When out and about after dark, the user would activate I-See, thus affording an illuminated path about their body that extends for a 10 feet, 360 degree perimeter. In this manner, one would clearly see where they were going, even on the darkest of nights, and others would be able to easily discern their presence on the road.

In summary, I-See is a practical product invention which would offer consumers a number of significant benefits and advantages. Foremost, I-See would provide pedestrians a practical way in which to ensure personal safety when walking outdoors at night. A cleverly designed portable light source incorporated into the design of a wearable belt, I-See would emit a brilliant beacon of light, 360 degrees about the wearer's body, with this light extending up to a 10 feet perimeter. Ideal for use by those who enjoy walking or running at night, I-See would prove an invaluable safety tool which would effectively prevent pedestrian accidents from occurring.

Advantageously, wear of I-See would potentially save lives. Parents should especially appreciate that with I-See, they would allow their young ones to safely play with neighborhood friends after the sun sets, without worrying that their child would be unseen by motorists. Not limited to use when walking or jogging, this wearable belt would also be employed when camping, hiking or engaged in other outdoor activities after dark. Enabling the wearer to clearly see his or her surroundings, this unique light source would prove especially useful when navigating one's way through the deep woods or other dark terrain. I-See would also be utilized indoors during emergency situations such as power outages or severe storms. Fully adjustable, I-See would provide a comfortable, non-cumbersome wear. Importantly, I-See would provide consumers a hands-free means of lighting their surroundings, thus sparing them the hassle of carrying a heavy flashlight when walking their dog or setting up camp after dark. Durably constructed, this product should withstand years of repeated use, with ease.

As such, I-See is an innovative product invention which would maximize safety when spending time outdoors at night. Easily donned and comfortable to wear, this illuminated belt would be well suited for use by adults, teens and children alike. Affordably priced, I-See should be well received by the general consumer populace, a very sizable market potential. I-See is cost-effective to produce in the embodiments, as shown in FIGS. 1-5.

Referring to the drawings by numerals of reference there is shown in FIG. 1, a portable lighting system 100 is disclosed for user 105. System 100 includes multiple spaced apart lighting features 102 arranged about circumferential surface 104 about user 105 in substantially 360 degree field of user view to provide hands-free lighting system. In some embodiments, multiple spaced apart lighting features 102, e.g., LIGHTS in FIG. 2, are Light Emitting Diodes (LEDs) and circumferential surface 104 includes belt, e.g., elongated belt in FIG. 2, that user 105 wears around their waist 107.

Figure 2:
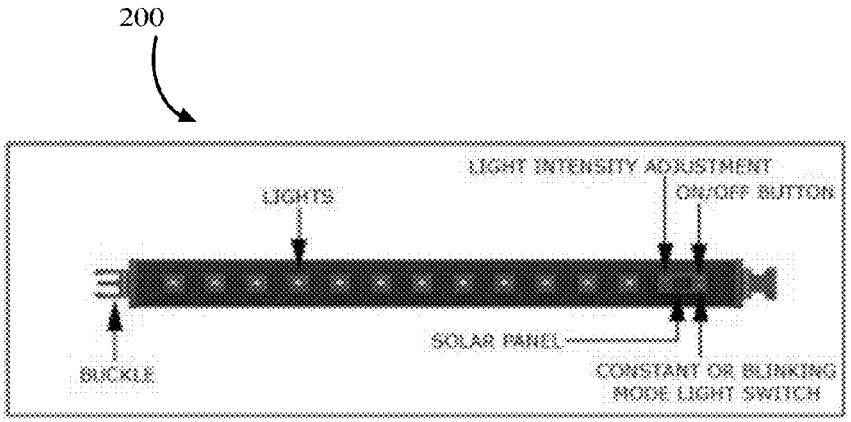
FIG. 2 is a perspective view illustrating a close-up of elongated belt, e.g., circumferential surface 104; buckle, e.g., tongue 110; fastener, e.g., adjustable groove buckle fasteners 112; lights that are square and spaced apart, e.g., multiple spaced apart lighting features 102; lighting intensity adjustment and on/off button, e.g., lighting intensity adjustment module 124 and lighting perimeter adjustment switch 114; solar panel, e.g., solar panel 112; and constant or blinking mode light switch, e.g., emergency flasher function 126, of portable, hands-free lighting system waistband belt of I-See according to an embodiment of the present invention of FIG. 1.

In some embodiments, most notably as illustrated in FIG. 2, circumferential surface 104 is elongated belt 108, and tongue 110, e.g., buckle, attaches to end of circumferential surface 104 and has adjustable groove buckle fasteners 112, e.g., fastener, on at least a portion along another end of circumferential surface 104 connect attachably to tongue 110 in a tongue and groove fashion.

Figure 3:
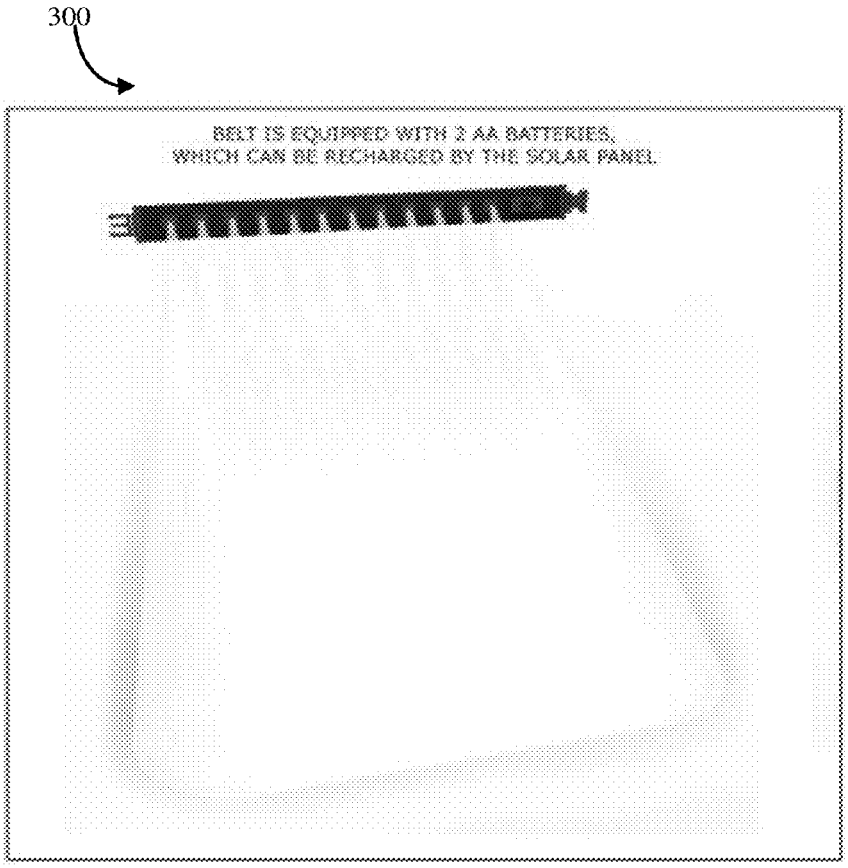
FIG. 3 is a perspective view illustrating operation with rechargeable batteries, e.g., rechargeable battery pack 122, of portable, hands-free lighting system waistband belt of I-See according to an embodiment of the present invention of FIG. 1.

In some embodiments, lighting perimeter adjustment switch 114 is provided, e.g., see FIG. 2, most notably light intensity adjustment and on/off button. In one example, lighting perimeter adjustment switch 114, e.g., see FIG. 2, most notably light intensity adjustment and on/off button attaches along circumferential surface 104. In one example, lighting perimeter adjustment switch 114, e.g., see FIG. 2, adjusts level of lighting of outer maximum range 120 of perimeter 116 of the substantially 360 degree field of user view. In some embodiments, lighting perimeter adjustment switch 114, e.g., see FIG. 2, for example, user attaches along the circumferential surface 104. In one instance, lighting perimeter adjustment switch 114, see FIG. 2, adjusts a level of lighting from minimum 118 and maximum 120 range of perimeter 116 of the substantially 360 degree field of user view. In some embodiments, rechargeable battery pack 122, e.g., see FIG. 3, is incorporated with circumferential surface 104. In one instance, rechargeable battery pack 122, e.g., see FIG. 3, is capable of being recharged via solar power.

In some embodiments, lighting intensity adjustment module 124, e.g., see FIGS. 2 and 3, provides one or more selectable states including illumination of all lights simultaneously, flash off all lights, emit a beacon of light, and illumination of one or more individual lights in a predetermined sequence. In some embodiments, multiple spaced apart lighting features 102 include Light Emitting Diodes (LEDs) that are a series of square shaped lights, encased behind shatterproof lenses, e.g., see FIGS. 2 and 3. In some embodiments, the substantially 360 degree field of user view includes a brilliant beam of light extended about a 10 feet perimeter about user 105. In some embodiments, emergency flasher function 126 is provided. In one example, emergency flasher function 126, e.g., see FIG. 2 constant or blinking mode light switch, capability includes a flashing brilliant beam of light that provides a highly visible means to facilitate a speedy rescue of user 105.

Most notably, I-See, has capability as compared with many conventional lighting systems and what sets this belt apart is found in belt's integrated light source. In particular, spaced evenly across the surface of the belt and expending the entire length of the unit would be a series of square shaped lights, encased behind shatterproof lenses. For practical purposes, I-See would be manufactured utilizing LED (light emitting diode) bulbs. LED bulbs are a filament-free light source that never burns out remains cool to the touch even after hours of continued use.

Advantageously, these lights also emit a brilliant beacon of light when activated, thus lending to the practicality of I-See. These lights would be powered by a rechargeable battery pack incorporated into the design of the unit, with this battery recharged via solar power. In one example, simple push button activation switches would also be included, with the wearer having four options for the illuminated display. These options include the illumination of selected lights; the illumination of all lights simultaneously; the flashing off all lights; and the illumination of the individual lights in sequence.

Advantageously, use and wear of I-See would be very simple and straight forward. First, the user would purchase a belt in the desired color and appropriate size. For instance, an avid runner might prefer a basic black belt for wear with his jogging clothes, while a homemaker might choose a pretty pink belt to wear when walking her dog.

Advantageously, the user would also utilize I-See during emergency situations, such as during a power outage, if one's vehicle breaks down, or virtually any other situation when a portable light source is necessary. The user might also employ the various illumination options in order to enhance their use of the belt. For instance, a hiker who becomes lost after dark might activate the unit's flashing function, thus providing a highly visible means of calling attention to himself that would facilitate a speedy rescue, while one enjoying an evening run might set the device so that all lights were illuminated simultaneously. After use, I-See would simply be turned off, recharged and stored away until again needed FIG. 2 is a perspective view illustrating a close-up of elongated belt, e.g., circumferential surface 104; buckle, e.g., tongue 110; fastener, e.g., adjustable groove buckle fasteners 112; lights that are square and spaced apart, e.g., multiple spaced apart lighting features 102; lighting intensity adjustment and on/off button, e.g., lighting intensity adjustment module 124 and lighting perimeter adjustment switch 114; solar charging and panel, e.g., solar panel 112; and constant or blinking mode light switch, e.g., emergency flasher function 126, of portable, hands-free lighting system waistband belt of I-See according to an embodiment of the present invention of FIG. 1.

FIG. 3 is a perspective view illustrating operation with rechargeable batteries, e.g., rechargeable battery pack 122, of portable, hands-free lighting system waistband belt of I-See according to an embodiment of the present invention of FIG. 1.

Figure 4:
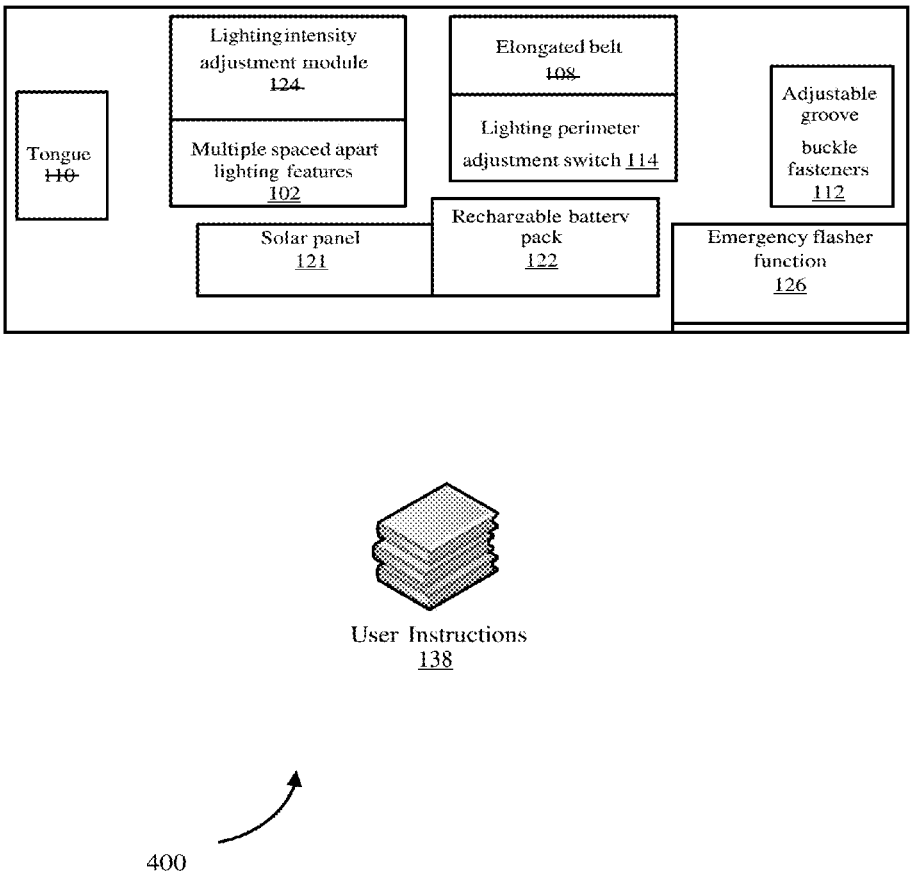
FIG. 4 is a perspective view illustrating a kit depicting portable, hands-free lighting system waistband I-See according to an embodiment of the present invention of FIG. 1.

Referring now to FIG. 4 is a perspective view illustrating a kit illustrating portable, hands-free lighting system waistband I-See according to an embodiment of the present invention of FIG. 1. I-See system 100 may be sold as kit 400 comprising the following parts: multiple spaced apart lighting feature(s) 102; tongue(s) 110, adjustable groove buckle fastener(s) 112, solar panel(s) 121, lighting intensity adjustment module(s) 124, lighting perimeter adjustment switch(s) 114, rechargeable battery pack(s) 122, circumferential surface(s) about the user 104, e.g., elongated belt(s) 108, and at least one set of user instructions 138. The kit has instructions such that functional relationships are detailed in relation to the structure of the invention (such that the invention can be used, maintained, or the like in a preferred manner). I-See 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
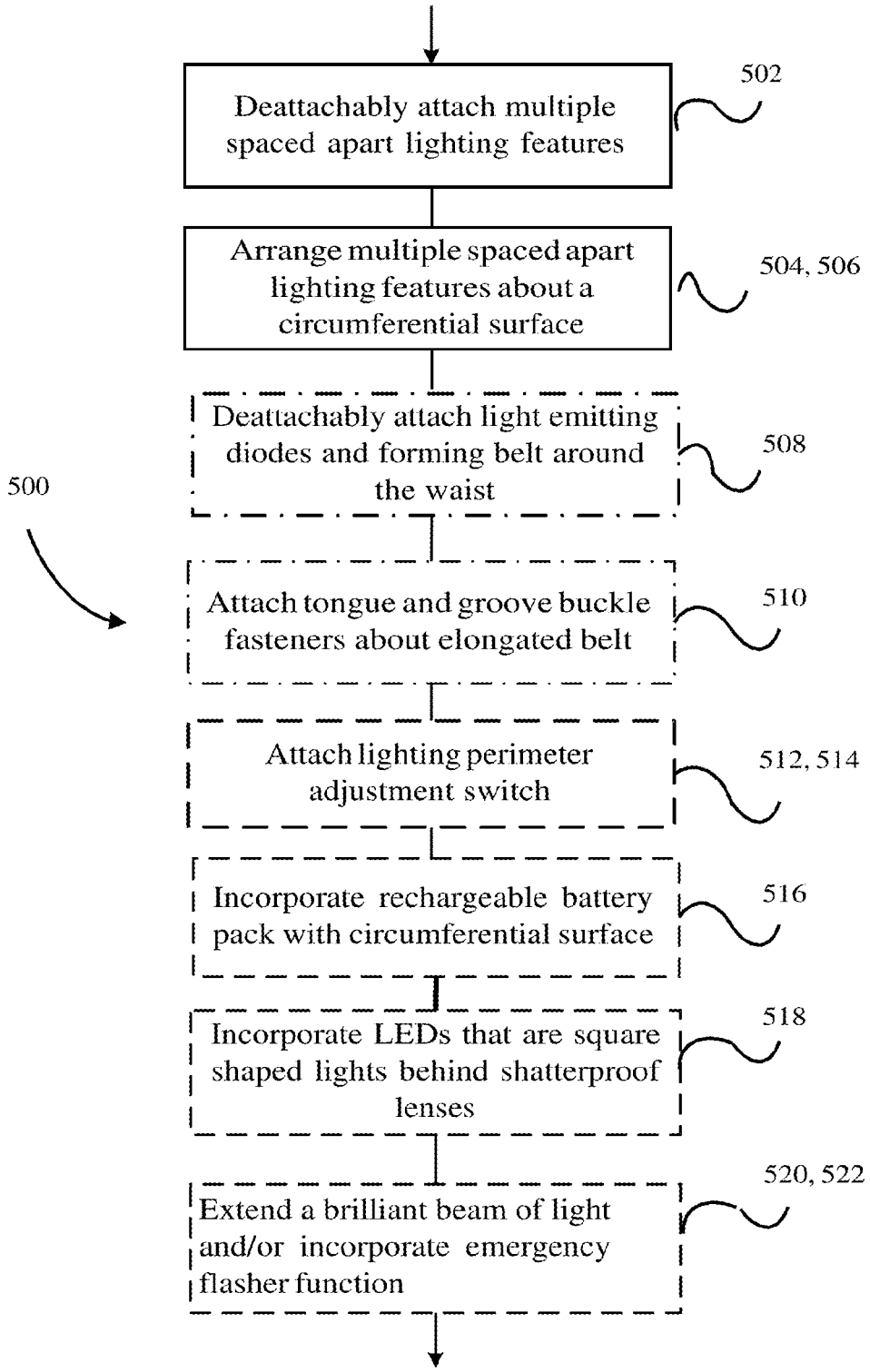
FIG. 5 is a flowchart illustrating a method of use for portable, hands-free lighting system waistband I-See according to an embodiment of the present invention of FIGS. 1-4.

Referring now to FIG. 5, method 500 is disclosed for creating a portable lighting system for a user. In step 502, multiple spaced apart lighting features 102 are detachably attached. In step 504, multiple spaced apart lighting features 102 are arranged about a circumferential surface 104 about user 105. In step 506, a substantially 360 degree field of user view is provided with this hands-free lighting system.

In step 508, multiple spaced apart lighting features 102 are Light Emitting Diodes (LEDs), and multiple spaced apart lighting features 102 are arranged about circumferential surface 104, which includes forming a belt that user 105 wears around their waist. In step 510, multiple spaced apart lighting features 102 are arranged about circumferential surface 104 about user 105 including: arranging circumferential surface 104 as part of elongated belt 108; attaching tongue 110 to end of circumferential surface 104; and attaching groove buckle fasteners 112 a portion along another end of circumferential surface 104 connect attachably to tongue 110 in a tongue and groove fashion.

In step 512, lighting perimeter adjustment switch 114 is attached along circumferential surface 104. In one example, lighting perimeter adjustment switch 114 adjusts a level of lighting of an outer maximum range 120 of perimeter 116 of the substantially 360 degree field of user view.

In step 514, lighting perimeter adjustment switch 114 attached along the circumferential surface. In one instance, lighting perimeter adjustment switch 114 adjusts a level of lighting from a minimum and maximum range of perimeter of the substantially 360 degree field of user view. In step 516, incorporating rechargeable battery pack 122 is incorporated with circumferential surface 104. In one instance, rechargeable battery pack 122 is capable of being recharged via solar power. In step 518, coupling a lighting intensity adjustment module 124. In one example, lighting intensity adjustment module 124 provides one or more selectable states including illumination of all lights simultaneously, flash off all lights, emit a beacon of light, and illumination of one or more individual lights in a predetermined sequence.

In step 518, Light Emitting Diodes (LEDs) are incorporated that are a series of square shaped lights, encased behind shatterproof lenses as part of multiple spaced apart lighting features 102. In step 520, brilliant beam of light extends about a 10 feet perimeter about the user in the substantially 360 degree field of the user view. In step 522, emergency flasher function 126 is incorporated. In one example, emergency flasher function 126 capability includes a flashing brilliant beam of light that provides a highly visible means to facilitate a speedy rescue.

It should be noted that step(s) 508-522 is/are optional step(s) and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. § 112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

Upon reading this specification, it should be appreciated that, under appropriate circumstances, considering such issues as user preferences, design preference, structural requirements, marketing preferences, cost, available materials, technological advances, etc., other portable, hands-free lighting arrangements such as, for example, head or foot or other portable mounted lighting systems, etc., may be sufficient.

Those with ordinary skill in the art will now appreciate that upon reading this specification and by their understanding the art of portable, hands-free lighting system as described herein, methods of portable, hands-free lighting will be understood by those knowledgeable in such art.

What is claimed:

1. A portable lighting system for a user comprising:

multiple spaced apart lighting features arranged about a circumferential surface about the user in a substantially 360 degree field of user view to provide a hands-free lighting system; and wherein the multiple spaced apart lighting features include Light Emitting Diodes (LEDs) that are a series of square shaped lights, encased behind shatterproof lenses.

2. The system of claim 1, wherein the multiple spaced apart lighting features are Light Emitting Diodes (LEDs) and the circumferential surfaces includes a belt that the user wears around their waist.

3. The system of claim 1, wherein the circumferential surface is an elongated belt; and further comprising a tongue attached to an end of the circumferential surface and having adjustable groove buckle fasteners end at least a portion along another end of the circumferential surface connect attachably to the tongue in a tongue and groove fashion.

4. The system of claim 1, comprising a lighting perimeter adjustment switch attached along the circumferential surface, the lighting perimeter adjustment switch adjusts a level of lighting of an outer maximum range of a perimeter of the substantially 360 degree field of user view.

5. The system of claim 1, comprising a lighting perimeter adjustment switch attached along the circumferential surface, the lighting perimeter adjustment switch adjusts a level of lighting from a minimum and maximum range of a perimeter of the substantially 360 degree field of user view.

6. The system of claim 1, comprising a rechargeable battery pack incorporated with the circumferential surface, the rechargeable battery pack capable of being recharged via solar power.

7. The system of claim 1, comprising an lighting intensity adjustment module, the lighting intensity adjustment module provides one or more selectable states including illumination of all lights simultaneously, flash off all lights, emit a beacon of light, and illumination of one or more individual lights in a predetermined sequence.

8. The system of claim 1, wherein the substantially 360 degree field of user view includes a brilliant beam of light extended about a 10 feet perimeter about the user.

9. The system of claim 1, comprising an emergency flasher function, the emergency flasher function capability includes a flashing brilliant beam of light that provides a highly visible means to facilitate a speedy rescue of the user.

10. A method for creating a portable lighting system for a user comprising:

deattachably attaching multiple spaced apart lighting features;

arranging the multiple spaced apart lighting features about a circumferential surface about the user;

providing a substantially 360 degree field of user view to provide a hands-free lighting system; and comprising extending a brilliant beam of light about a 10 feet perimeter about the user in the substantially 360 degree field of the user view.

11. The method of claim 10, wherein deattachably attaching the multiple spaced apart lighting features are Light Emitting Diodes (LEDs), and wherein arranging the multiple spaced apart lighting features about a circumferential surface includes forming a belt that the user wears around their waist.

12. The method of claim 10, wherein arranging the multiple spaced apart lighting features about a circumferential surface about the user includes:

i.) arranging the circumferential surface as part of an elongated belt;

ii.) attaching a tongue to an end of the circumferential surface; and iii.) attaching groove buckle fasteners at least a portion along another end of the circumferential surface connect attachably to the tongue in a tongue and groove fashion.

13. The method of claim 10, comprising attaching a lighting perimeter adjustment switch along the circumferential surface, the lighting perimeter adjustment switch adjusts a level of lighting of an outer maximum range of a perimeter of the substantially 360 degree field of user view.

14. The method of claim 10, comprising attaching a lighting perimeter adjustment switch along the circumferential surface, the lighting perimeter adjustment switch adjusts a level of lighting from a minimum and maximum range of a perimeter of the substantially 360 degree field of user view.

15. The method of claim 10, comprising incorporating a rechargeable battery pack with the circumferential surface, the rechargeable battery pack capable of being recharged via solar power.

16. The method of claim 10, comprising coupling an lighting intensity adjustment module, the lighting intensity adjustment module provides one or more selectable states including illumination of all lights simultaneously, flash off all lights, emit a beacon of light, and illumination of one or more individual lights in a predetermined sequence.

17. The method of claim 10, comprising Light Emitting Diodes (LEDs) that are a series of square shaped lights, encased behind shatterproof lenses as part of the multiple spaced apart lighting features.

18. The method of claim 10, comprising incorporating an emergency flasher function, the emergency flasher function capability includes a flashing brilliant beam of light that provides a highly visible means to facilitate a speedy rescue.

19. A portable lighting system for a user comprising:

multiple spaced apart lighting features arranged about a circumferential surface about the user in a substantially 360 degree field of user view to provide a hands-free lighting system; and an emergency flasher function, the emergency flasher function capability includes a flashing brilliant beam of light that provides a highly visible means to facilitate a speedy rescue of the user.

* * * * *